US006959772B2

(12) United States Patent
Stegmaier et al.

(10) Patent No.: US 6,959,772 B2
(45) Date of Patent: Nov. 1, 2005

(54) SELF-PENETRATING SOIL EXPLORATION DEVICE AND ASSOCIATED METHODS

(75) Inventors: Shawn C. Stegmaier, Oakton, VA (US); Dean Vidal, Brightwood, VA (US); Gordon M. Matheson, Mechanicsville, VA (US); Gene Van Dyck, Arlington, VA (US)

(73) Assignee: General Dynamics Advanced Information Systems, Inc., Arlington, VA (US)

( * ) Notice: Subject to any disclaimer, the term of this patent is extended or adjusted under 35 U.S.C. 154(b) by 103 days.

(21) Appl. No.: 10/438,317

(22) Filed: May 15, 2003

(65) Prior Publication Data

US 2004/0226747 A1 Nov. 18, 2004

(51) Int. Cl.[7] ..... E21B 7/06
(52) U.S. Cl. ..... 175/61; 175/19; 175/73
(58) Field of Search ..... 175/19, 61, 73

(56) References Cited

U.S. PATENT DOCUMENTS

| | | | | |
|---|---|---|---|---|
| 2,946,578 A | | 7/1960 | De Smaele | |
| 3,224,734 A | | 12/1965 | Hill | |
| 3,330,368 A | | 7/1967 | Baran et al. | |
| 3,797,586 A | * | 3/1974 | Coyne et al. | 173/133 |
| 3,827,512 A | | 8/1974 | Edmond | |
| 3,881,776 A | | 5/1975 | Fashbaugh et al. | |
| 3,926,267 A | * | 12/1975 | Svirschevsky et al. | 175/19 |
| 3,970,157 A | * | 7/1976 | Schmidt | 175/22 |
| 3,978,930 A | | 9/1976 | Schroeder | |
| 4,095,435 A | | 6/1978 | Uemura | |
| 4,095,655 A | | 6/1978 | Still | |
| 4,742,876 A | | 5/1988 | Barthelemy et al. | |
| 4,921,055 A | | 5/1990 | Kayes | |
| 4,938,297 A | | 7/1990 | Schmidt | |
| 5,111,891 A | * | 5/1992 | Kinnan | 175/21 |
| 5,527,220 A | | 6/1996 | Geczy | |
| 5,649,745 A | | 7/1997 | Anderson | |
| 5,758,731 A | | 6/1998 | Zollinger | |
| 6,286,592 B1 | | 9/2001 | Moore et al. | |
| 6,308,787 B1 | | 10/2001 | Alft | |

FOREIGN PATENT DOCUMENTS

WO WO 02/084065 10/2002

* cited by examiner

*Primary Examiner*—Zakiya Walker
(74) *Attorney, Agent, or Firm*—Steptoe & Johnson LLP

(57) ABSTRACT

Methods and apparatuses for maneuvering through a medium such as soil are disclosed. One such apparatus has a generally longitudinal body that can impel itself through the medium. This apparatus also has at least two independently-controllable packers arranged radially on its body to compress and grip the medium in order to provide forward, backward, and directional impulsion.

35 Claims, 17 Drawing Sheets

FIG. 15

| 1502 MATERIAL | 1505 CONE TIP DIAMETER(IN) | 1510 AREA (SQ IN) | 1515 CONE TIP RESISTANCE(PEF) | 1520 REQUIRED DRIVING FORCE(LBS) | 1525 2 INCH BODY REACTION (LBS/FT PACKER)* | 1530 REQUIRED MAIN PACKER LENGTH(FT) | 1535 3 INCH BODY REACTION (LBS/FT PACKER) | 1540 REQUIRED MAIN PACKER LENGTH(FT) |
|---|---|---|---|---|---|---|---|---|
| SOFT CLAY | 1.4 | 1.54 | 4000 | 42.74 | 1105 | 0.04 | 1657 | 0.03 |
| MEDIUM CLAY | 1.4 | 1.54 | 30000 | 320.54 | 1105 | 0.29 | 1657 | 0.19 |
| STIFF CLAY | 1.4 | 1.54 | 100000 | 1068.47 | 1105 | 0.97 | 1657 | 0.64 |
| LOOSE SAND | 1.4 | 1.54 | 10000 | 106.85 | 3480 | 0.03 | 5220 | 0.02 |
| MEDIUM SAND | 1.4 | 1.54 | 100000 | 1068.47 | 3480 | 0.31 | 5220 | 0.20 |
| DENSE SAND | 1.4 | 1.54 | 300000 | 3205.42 | 3480 | 0.92 | 5220 | 0.61 |
| SOFT CLAY | 2.0 | 3.14 | 4000 | 87.22 | 1105 | 0.08 | 1657 | 0.05 |
| MEDIUM CLAY | 2.0 | 3.14 | 30000 | 654.17 | 1105 | 0.59 | 1657 | 0.39 |
| STIFF CLAY | 2.0 | 3.14 | 100000 | 2180.56 | 1105 | 1.97 | 1657 | 1.32 |
| LOOSE SAND | 2.0 | 3.14 | 10000 | 218.06 | 3480 | 0.06 | 5220 | 0.04 |
| MEDIUM SAND | 2.0 | 3.14 | 100000 | 2180.56 | 3480 | 0.63 | 5220 | 0.42 |
| DENSE SAND | 2.0 | 3.14 | 300000 | 6541.67 | 3480 | 1.88 | 5220 | 1.25 |

FIG. 16

| 1605 MAIN PACKER DIAMETER (IN) | 1610 PERIMETER AREA (SQFT/FT) | 1615 DEPTH (FT) | 1620 SOIL FAILURE PRESSURE (PSF) | 1625 SOIL FRICTION FACTOR | 1630 PACKER LENGTH (FT) | 1635 PACKER EFFECTIVE LENGTH (FT) | 1640 SAND REACTION FORCE (LBS/FT PACKER) |
|---|---|---|---|---|---|---|---|
| 2 | 0.52 | 10 | 10,000 | 0.7 | 1 | 0.95 | 3480 |
| 3 | 0.79 | 10 | 10,000 | 0.7 | 1 | 0.95 | 5220 |

FIG. 17

| MAIN BODY DIAMETER (IN) | PERIMETER AREA (SQFT/FT) | 1710 DEPTH (FT) | 1715 SOIL FAILURE PRESSURE (PSF)* | 1720 SOIL FRICTION FACTOR** | 1725 PACKER LENGTH (FT) | 1730 PACKER EFFECTIVE LENGTH*** | 1740 CLAY REACTION FORCE (LBS/FT PACKER) |
|---|---|---|---|---|---|---|---|
| 2 | 0.52 | 10 | 5500 | 0.404 | 1 | 0.95 | 1105 |
| 3 | 0.79 | 10 | 5500 | 0.404 | 1 | 0.95 | 1657 |

SELF-PENETRATING SOIL EXPLORATION DEVICE AND ASSOCIATED METHODS

BACKGROUND OF THE INVENTION

1. Field of the Invention

The invention relates to systems and methods of locomotion through soil. More particularly, the invention relates to a self-propelled maneuverable device capable of delivering instrumentation underground.

2. Discussion of Background Information

Devices for tunneling through soil (e.g., by way of drilling) are known. Examples of such devices include oil derricks and other geological equipment. Such devices are generally associated with drilling equipment.

Packers are expandable plugs typically used to isolate sections in an oil well, borehole, or water well. Generally, to isolate a well section, a packer is inserted and a bladder attached to the packer is expanded. This action substantially seals the well section by providing a mechanical barrier.

SUMMARY OF THE INVENTION

According to a preferred embodiment of the invention, an apparatus for maneuvering through soil is provided. The apparatus has a substantially longitudinal body including a front end. The body is configured to impel itself through a medium comprising solid matter. The apparatus also has a manipulable nose section including at least one of: at least two members arranged radially on the front end, each member controllably protrudable in a substantially radial direction relative to the longitudinal body, a rotatable off-center nose section, and a pivotable nose section. Preferably, manipulating the nose section alters a direction of travel of the apparatus.

Various optional and preferable features of the above embodiment include that the body comprises expandable bladders configured to assist in impelling the body. The embodiment may have a manipulable nose section that comprises at least three members arranged radially on the front end. The manipulable nose section may have at least two members comprising expandable bladders arranged radially on the front end. The embodiment may have a manipulable nose section comprising a rotatable off-center nose section, the rotatable off-center nose section including a member that is eccentric to the body. The embodiment may have a manipulable nose section comprising a pivotable nose section, the pivotable nose section comprising a ball-and-socket joint. The embodiment may have a substantially longitudinal body that comprises at least one joint configured to allow a first portion of the substantially longitudinal body to form a nonzero angle with respect to a second portion of the substantially longitudinal body.

According to another embodiment of the invention, an apparatus for maneuvering through a medium such as soil is provided. The apparatus has a substantially longitudinal body, where at least two expandable portions of the body are capable of engaging surrounding media. The apparatus also has a linear extender capable of extending the body in a longitudinal direction. The apparatus also includes a manipulable nose section, where manipulating the manipulable nose section preferably alters a direction of travel of the apparatus.

Various optional and preferable features of the above embodiment include that the expandable portions comprise expandable bladders. The manipulable nose section may have at least two members arranged radially on the front end, the at least two members comprising expandable bladders. The manipulable nose section may comprise a rotatable off-center nose section, the rotatable off-center nose section comprising a substantially conical member that is eccentric to the body. The manipulable nose section may alternately, or in addition, comprise a pivotable nose section, the pivotable nose section comprising a ball-and-socket joint. The substantially longitudinal body comprises at least one joint configured to allow a first portion of the substantially longitudinal body to form a nonzero angle with respect to a second portion of the substantially longitudinal body.

According to another embodiment of the invention, an apparatus for maneuvering through soil is provided. The apparatus has a substantially longitudinal body, the body configured to impel itself through a medium comprising solid matter in substantially a direction parallel to the longitudinal body. The apparatus has a controllably manipulable nose section. Controllably manipulating the controllably manipulable nose section preferably alters a direction of travel of the apparatus.

Various optional and preferable features of the above embodiment include that the body comprises expandable bladders configured to assist in impelling the body. The controllably manipulable nose section may comprise a hydraulically controllably manipulable nose section. The controllably manipulable nose section may be controllably manipulable in a plurality of directions. The controllably manipulable nose section may be capable of rotating, may be capable of being positioned at an off-center angle, or may comprise at least two protrudable members. The substantially longitudinal body may have a plurality of sections, at least one of the plurality of sections being capable of forming a nonzero angle with respect to another of the plurality of sections.

According to another embodiment of the invention, a method of maneuvering through soil is provided. The method includes gripping an inside surface of a channel. The method also includes advancing at least a portion of a substantially longitudinal body through the channel in a first direction of travel, the first direction of travel being substantially parallel to the longitudinal body. The method also includes manipulating a nose section. Preferably, manipulating the nose section alters the first direction of travel to produce a second direction of travel that is eccentric to the first direction of travel.

Various optional and preferable features of the above embodiment include that the manipulating comprises hydraulically manipulating. The manipulating may alternately, or in addition, comprise positioning the nose section off-center, rotating the nose, or extending at least one member. The substantially longitudinal body may have a plurality of sections, at least one of the plurality of sections being capable of forming a nonzero angle with respect to another of the plurality of sections.

According to another embodiment of the invention, a method of maneuvering through soil is provided. The method includes gripping an inside surface of a channel and advancing at least a portion of a substantially longitudinal body through the channel in a first direction of travel, the first direction of travel being substantially parallel to the longitudinal body. The method also includes controllably changing directional characteristics of a nose section. Preferably, the controllably changing alters the first direction of travel to produce a second direction of travel that is eccentric to the first direction of travel.

Various optional and preferable features of the above embodiment include that the controllably changing comprises expanding bladders. The controllably changing may comprise positioning the nose section at a nonzero angle to the first direction of travel. The controllably changing may alternately comprise rotating. The substantially longitudinal body may include a plurality of sections, at least one of the plurality of sections being capable of forming a nonzero angle with respect to another of the plurality of sections.

According to another embodiment of the invention, a method of altering a direction of travel of a mechanical burrowing device is provided. The method includes providing a mechanical burrowing device having a longitudinal orientation and a radial orientation and controllably manipulating a nose section of the mechanical burrowing device. The controllably manipulating comprises at least one of: rotating the nose section, positioning the nose section off-center from the longitudinal direction, and extending at least one member radially from the nose section. The method also includes gripping an inside of a hole in which the mechanical burrowing device is disposed, and expanding in a longitudinal direction at least a portion of the mechanical burrowing device. Preferably, the controllably manipulating causes the mechanical burrowing device to alter a direction of travel.

Various optional and preferable features of the above embodiment include that the gripping comprises expanding a bladder. The expanding may comprise expanding using hydraulic force. The substantially longitudinal body may comprise a plurality of sections, at least one of the plurality of sections being capable of angling with respect to another of the plurality of sections.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein:

FIG. 15 is a chart of estimated resistance forces for different body lengths and soil types;

FIG. 16 is a chart estimating reaction forces against sand; and

FIG. 17 is chart estimating reaction forces against clay.

DETAILED DESCRIPTION OF THE EXEMPLARY EMBODIMENT

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
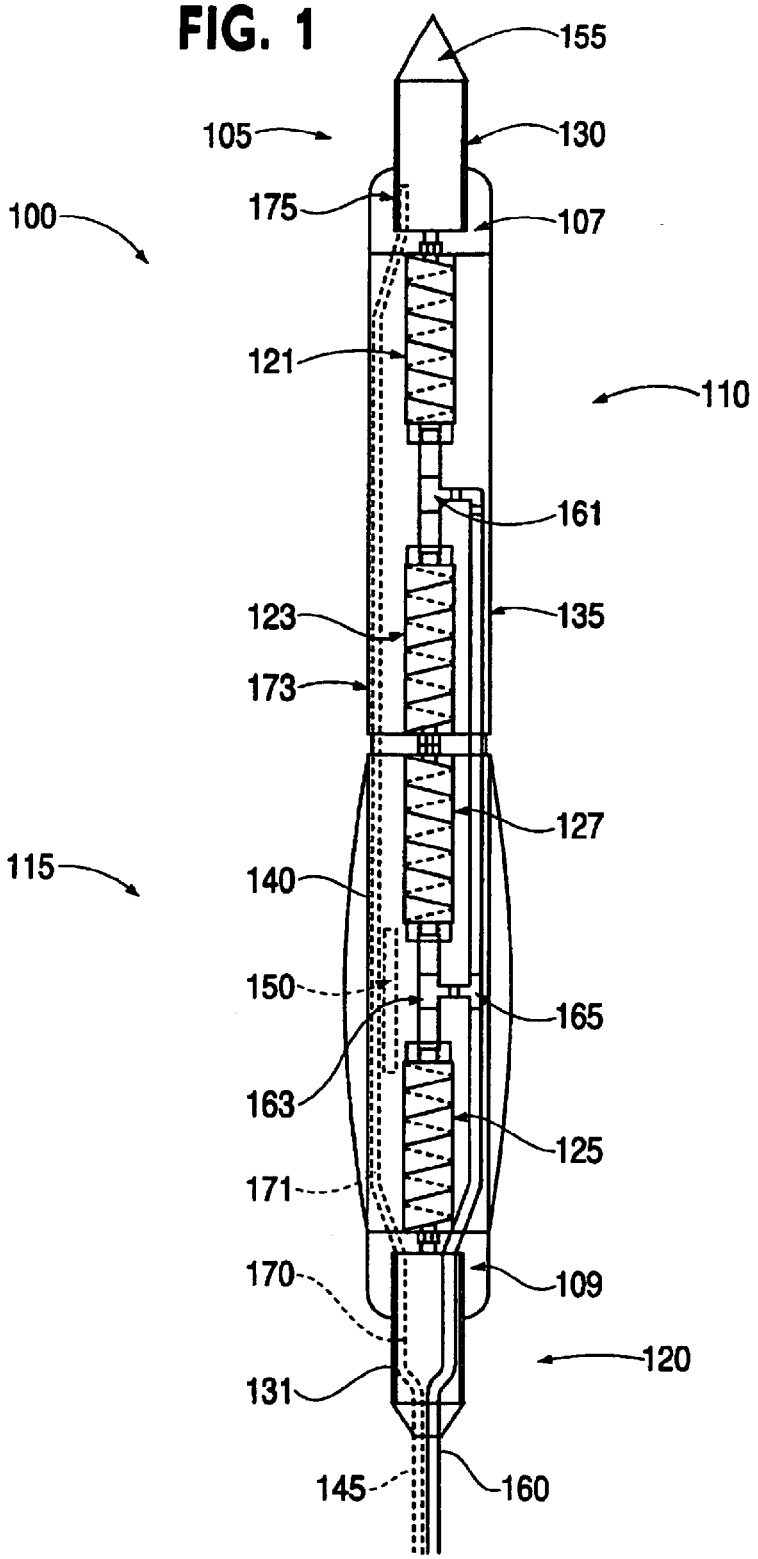
FIG. 1 is a diagram of a self-penetrating soil exploration device.

FIG. 1 depicts an embodiment of a self-penetrating soil exploration device ("worm") 100. Worm 100 preferably has four sections: nose section 105, front section 110, rear section 115, and tail section 120. Single-action spring-return hydraulic cylinders 121, 123, 125, 127 are interposed between adjacent sections. Hydraulic cylinder 121 is configured to extend and retract nose section 105 relative to a protective shield 107 of front section 110. Similarly, hydraulic cylinder 125 is configured to extend and retract tail section 120 relative to a protective shield 109 of rear section 115. Front and rear sections 110, 115 are linked by opposing hydraulic cylinders 123 and 127. Opposing hydraulic cylinders 123, 127 are preferably attached at their respective pushrods in order to provide bi-directional thrust. Preferably, cylinders 121, 123, 125, 127 are capable of producing a linear force of between 1000 and 4000 lbs. Suitable hydraulic cylinders include model TS-9381ST, available from Enerpac of Milwaukee, Wis. Other hydraulic cylinders or devices for providing linear thrust may be used.

Front section 110 and rear section 115 are surrounded by packers 135, 140, respectively, each configured to increase the diameter of these sections preferably by about 1 inch. FIG. 1 shows packer 135 deflated and packer 140 expanded. Nose section 105 and tail section 120 are surrounded by packers 130, 131, respectively (shown deflated in FIG. 1), which preferably expand to the diameter of front and rear sections 110, 115, measured with packers 135, 140 deflated (e.g., about 2 inches).

Preferable dimensions for worm sections 105, 110, 115, 120 are as follows. Nose section 105 is preferably 3 inches long and 1.40 inches in diameter. Front section 110 and rear section 115 are each preferably 10 inches long and 2 inches in diameter. Tail section 120 is preferably 3 inches long and 1.40 inches in diameter. Other dimensions of these sections are also possible.

Hydraulic cylinders 121, 123, 125, 127 receive hydraulic power via cylinder supply line 160. Each cylinder 121, 123, 125, 127 is preferably connected to cylinder supply line 160 via one of cylinder control valves 161, 163, and 165. More specifically, cylinder supply line 160 feeds initial cylinder control valve 165, which connects to cylinder control valve 163 and cylinder control valve 161. Cylinder control valve 163 provides individualized hydraulic fluid flow to hydraulic cylinder 127 and hydraulic cylinder 125. Cylinder control valve 161 supplies hydraulic fluid to either or both of hydraulic cylinder 121 and 123. Each cylinder control valve 161, 163, 165 is preferably electrically activated and independently controllable. Cylinder supply line 160 is preferably ¼ inch outside diameter, 0.049 inch wall thickness stainless steel tubing capable of containing pressures of about 5000 psi (e.g., model No. 89895K725 available from McMaster-Carr of Chicago, Ill.). Other cylinder supply lines may be used.

Packers 130, 131, 135, 140 are fed by packer supply line 145. Each packer connects to packer supply line 145 through an individual packer control valve. Specifically, tail section packer control valve 170 controls tail section packer 120, rear section packer control valve 171 controls rear section packer 140, front section packer control valve 173 controls front section packer 135, and nose section packer control valve 175 controls nose section packer 130. Each packer control valve 170, 171, 173, 175 is preferably electrically operated and independently controllable. Packer supply line is preferably ¼ inch outer diameter, 0.08 inch inside diameter nylon tubing capable of containing pressures of about 1500 psi. Other packer supply lines may be used.

Worm 100 also receives electrical power for instrumentation and valve control. Instrumentation may include, by way of non-limiting example, an inclinometer 150 and a cone penetrometer 155 mounted in or on nose section 105, each of which may receive electrical power. Inclinometer 150 preferably provides data on pitch and yaw angles of worm 100. Inclinometer may also provide data on worm 100 roll angle. Those of ordinary skill in the art may use known techniques to process data from inclinometer in conjunction with total distance traveled by worm 100 (as measured by amount of tether extended) to determine an instantaneous absolute position of worm 100. Such an instantaneous absolute position may be presented as, by way of non-limiting example, a point in space as described by x, y, and z-axes (i.e., a point in Euclidean space). Each valve 161, 163, 165, 170, 171, 173, and 175 preferably receives electrical signals independently, which set the state of each valve as open or closed. Both instrumentation and controls (e.g., control valves) may communicate with an operator above ground by sending and receiving electrical signals though a tether.

Figure 2:
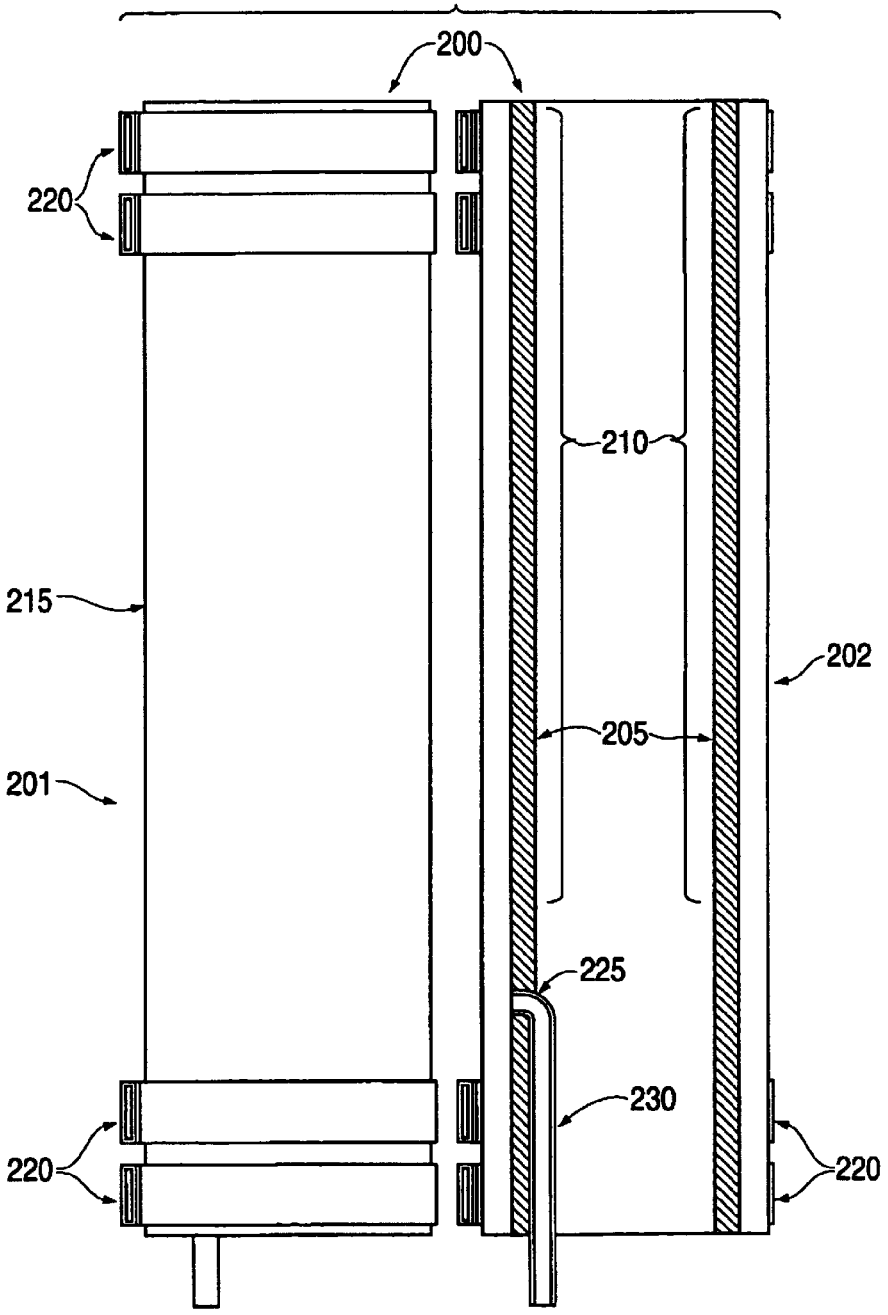
FIG. 2 depicts a packer.

FIG. 2 presents a plain view 201 and cross-section 202 of a packer 200 (e.g., 135, 140 of FIG. 1). Packer 200 includes stainless steel tube 205 (e.g., 110, 115 of FIG. 1). Tube 205 is internally threaded. Tube 205 is surrounded by flexible membrane 215, which is preferably constructed of rubber reinforced by either steel or KEVLAR™. Membrane 215 is secured to tube 205 via two sets of two stainless steel clips 220. Steel tube 205 is preferably perforated with through-hole 225 so that membrane 215 may be inflated (i.e., packer 200 may be expanded) via tubing 230. Packer 200 is preferably capable of hydraulic inflation at a pressure of between 10 and 75 psi. More preferably, packer 200 is capable of hydraulic inflation at a pressure of between 20 and 50 psi. Suitable packers are available from Roctest, Ltd. of Quebec, Canada.

Preferable dimensions of packer 200 of FIG. 2 are as follows. Tube 205 is preferably 12 inches long with a 1 11/16 inch inside diameter. Internal threads 210 preferably extend along 8 inches of its length starting at the end opposite of through-hole 225. Threads 210 are preferably 1/16 inch deep with a density of 16 threads per inch. Tube 205 together with uninflated membrane 215 preferably measures about 2½ inches in diameter. The inflated packer 200 preferably has a diameter of between 1.4 and 2.2 times that of tube 205 together with uninflated membrane 215. The above dimensions are exemplary and are not meant to be limiting.

Figure 3:
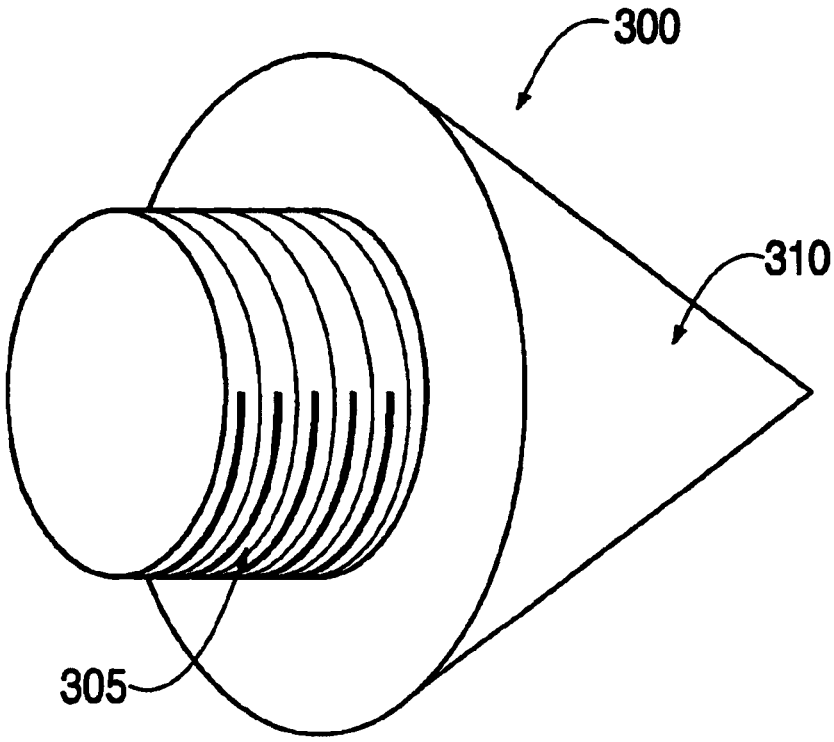
FIG. 3 depicts a cone penetrometer.

FIG. 3 depicts a nose cone 300, suitable for use in nose section 105 (e.g., with cone penetrometer 155). Nose cone 300 includes a threaded portion 305 and a conical portion 310. Threaded portion 305 is preferably ¾ inch in diameter with 16 threads per inch. Conical portion 310 is preferably 1.40 inches in diameter at its base. Nose cone 300 is preferably constructed of stainless steel. Nose cone 300 may include a load cell or penetrometer in order to measure thrust resistance (soil compaction force). Such a load cell or penetrometer may be placed in-line with nose cone 300, such as, by way of non-limiting example, at the tip of nose cone 300.

Figure 4:
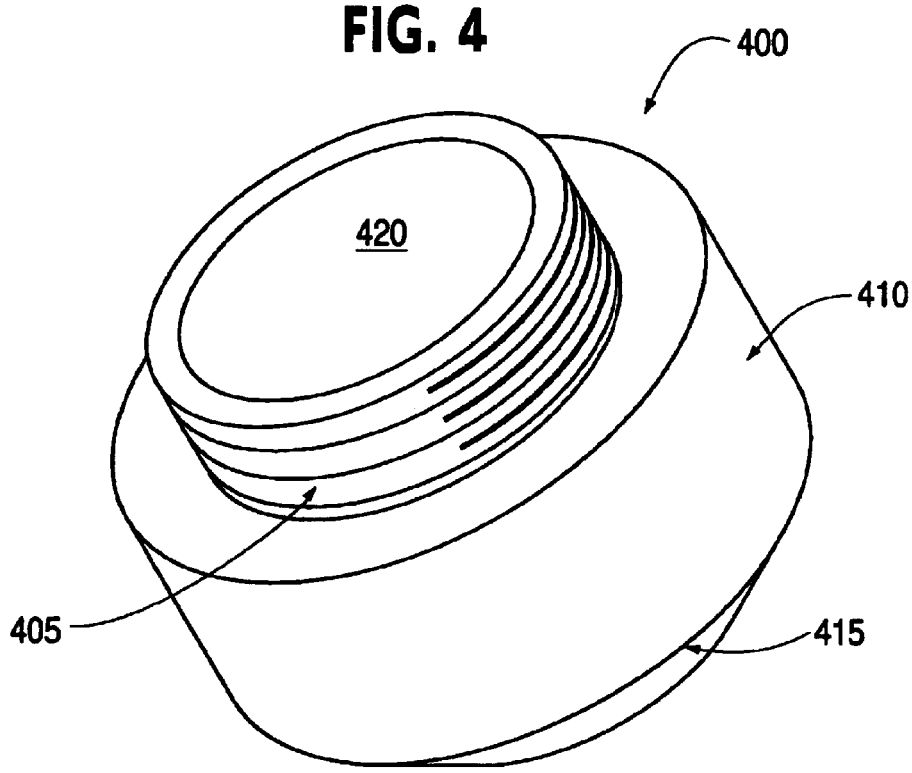
FIG. 4 depicts a protective shield.

FIG. 4 depicts a protective shield 400 (e.g., 107, 109 of FIG. 1). Protective shield 400 includes three sections: threaded section 405, protective section 410, and frustum section 415. Frustum section 415 tapers away from protective section. All three sections 405, 410, 415 include through-hole 420. Protective shield 400 is preferably constructed of stainless steel.

Preferable dimensions for the protective shield of FIG. 4 are as follows. Threaded section 405 preferably has an outside diameter of 1¾ inches and is preferably threaded at a rate of 16 threads per inch on its outside surface. Through-hole 420 is preferably 2½ inches in diameter.

Figure 5:
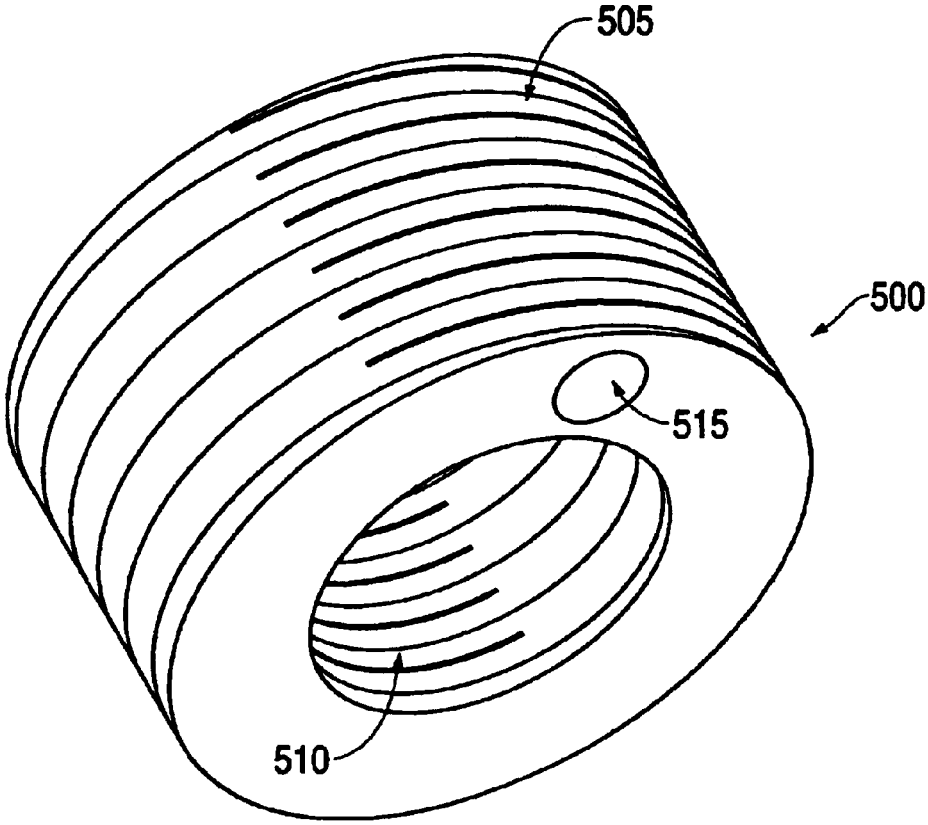
FIG. 5 depicts an internal disk.

FIG. 5 depicts an internal disk 500, used to fix hydraulic cylinders (e.g., 121, 123, 125, 127 of FIG. 1) within worm front and rear sections (e.g., 110, 115 of FIG. 1). Internal disk 500 is preferably 1¾ inches in diameter with 16 threads per inch on its outside surface 505. Internal disk 500 thereby is configured to mesh with threads internal to worm body sections (e.g., 210 of FIG. 2). Internal disk 500 includes a center through-hole 510 configured to receive and hold a hydraulic cylinder. Center through-hole is preferably 1 inch in diameter. Center through-hole 510 is preferably machined to have 12 threads per inch. Internal disk 500 also includes an offset through-hole 515 configured to allow hydraulic tubing to pass. Offset through-hole 515 is preferably ¼ inch in diameter.

Figure 6:
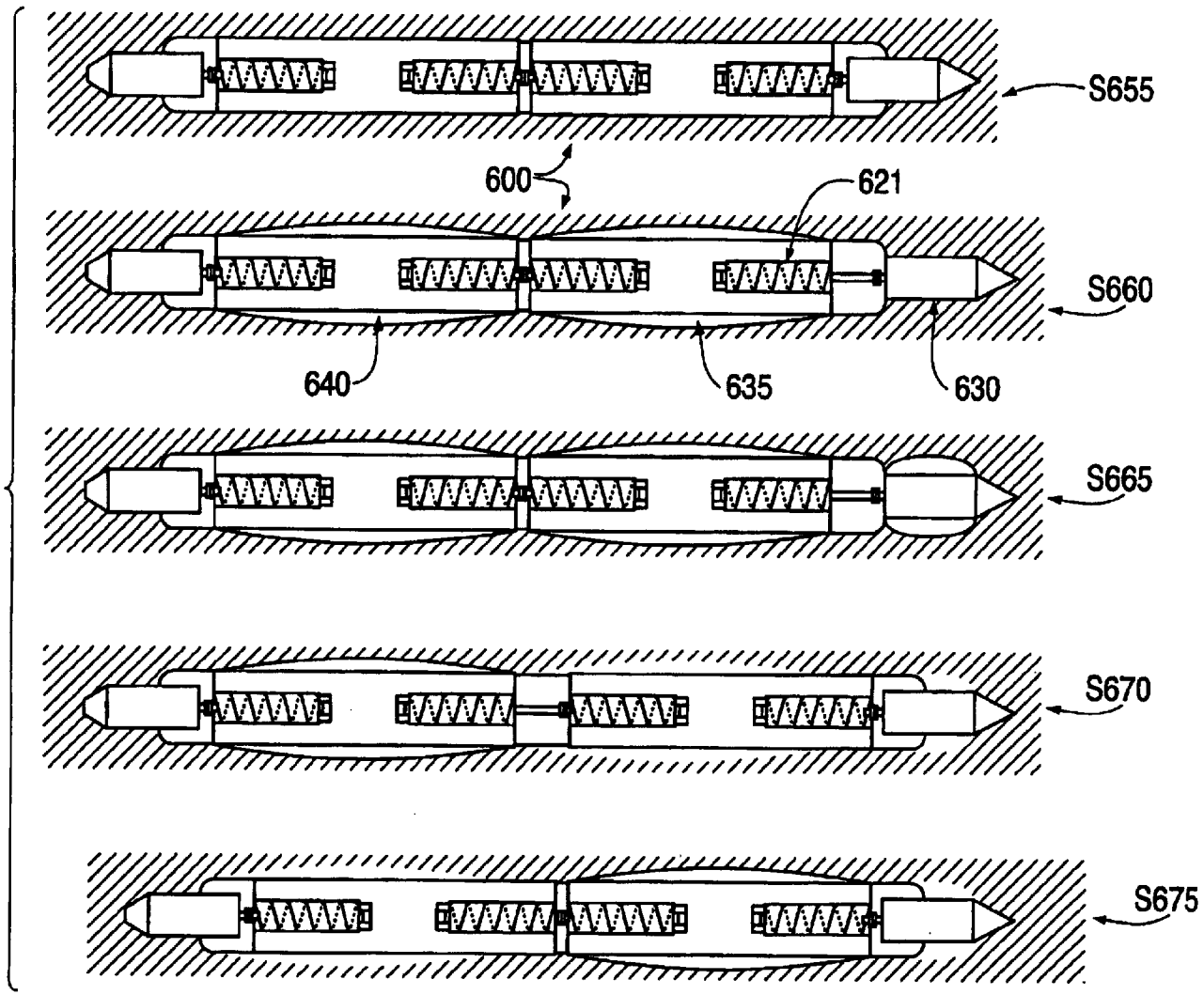
FIG. 6 depicts locomotion of a self-penetrating soil exploration device.

FIG. 6 illustrates various operating states of a worm 600 during locomotion. Worm 600 is initially at rest at step S655, with no packers inflated nor hydraulic cylinders expanded. To begin a locomotion cycle, at step S660 worm 600 expands one or both of front and rear section packers 635, 640, respectively, to anchor those sections in the soil. Worm 600 then extends nose section hydraulic cylinder 621. In combination with the anchors set by expanded packers 635, 640, cylinder 621 forces nose section 605 forward into the soil. Next at step S665, worm 600 compresses the soil around nose section 605 by inflating nose section packers 630, described further below in reference to FIG. 7. Worm 600 proceeds at step S670 to deflate front section packer 635, deflate nose section packer 630, retract nose section 605, and extend rear section hydraulic cylinder 623. Based on the anchored states of nose section 605, this causes front section 610 to advance forward into the gap left by soil compression, while rear section 615 remains stationary. Steps S665 and S670 may occur substantially simultaneously. At step S675, worm 600 anchors front section 610 by inflating front section packer 635, deflating rear section packer 640, and withdrawing hydraulic cylinder 623. Rear section 615 is thereby pulled forward, completing the cycle.

Figure 7:
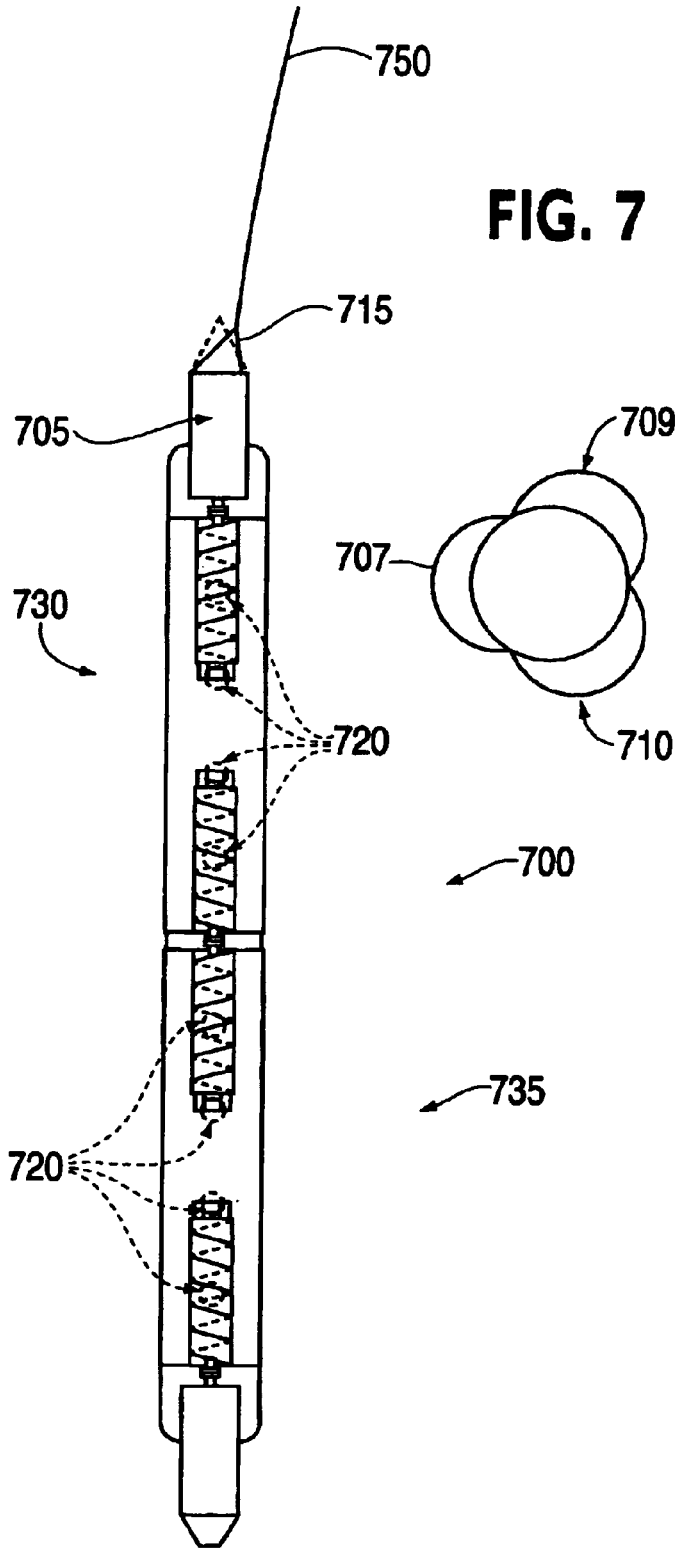
FIG. 7 depicts maneuverability features of the device illustrated in FIG. 1.

FIG. 7 depicts maneuverability features of a self-penetrating soil exploration device ("worm") 700. Nose section 705 is surrounded by directional packers 707, 709, 710. Each directional packer 707, 709, 710 covers about one-third of the arcuate surface of nose section 705. Expanding one directional packer will compress soil pressure in that region and leave a gap in the soil upon deflation. During subsequent motion of worm 700, nose section 705 will tend to travel through the gap (as the path of least resistance) rather than through soil. In this manner, worm movement is channeled into the gap. That is, expanding one or more directional packers at a point in the locomotion cycle when the nose section is extended will direct subsequent movement 750 of worm 700 in the direction of expansion.

Each directional packer is independently controllable. With three or more directional packers, worm 700 is maneuverable in three dimensions. That is, worm 700 is capable of not only forward and reverse movement, but also up, down, left, right, and other directions relative to forward movement. Worm 700 also includes rotatable section joints 720. By way of non-limiting example, each of front section 730 and rear section 735 divided into five subsections with a rotatable section joint 720 between each adjacent subsection pair.

Figure 8:
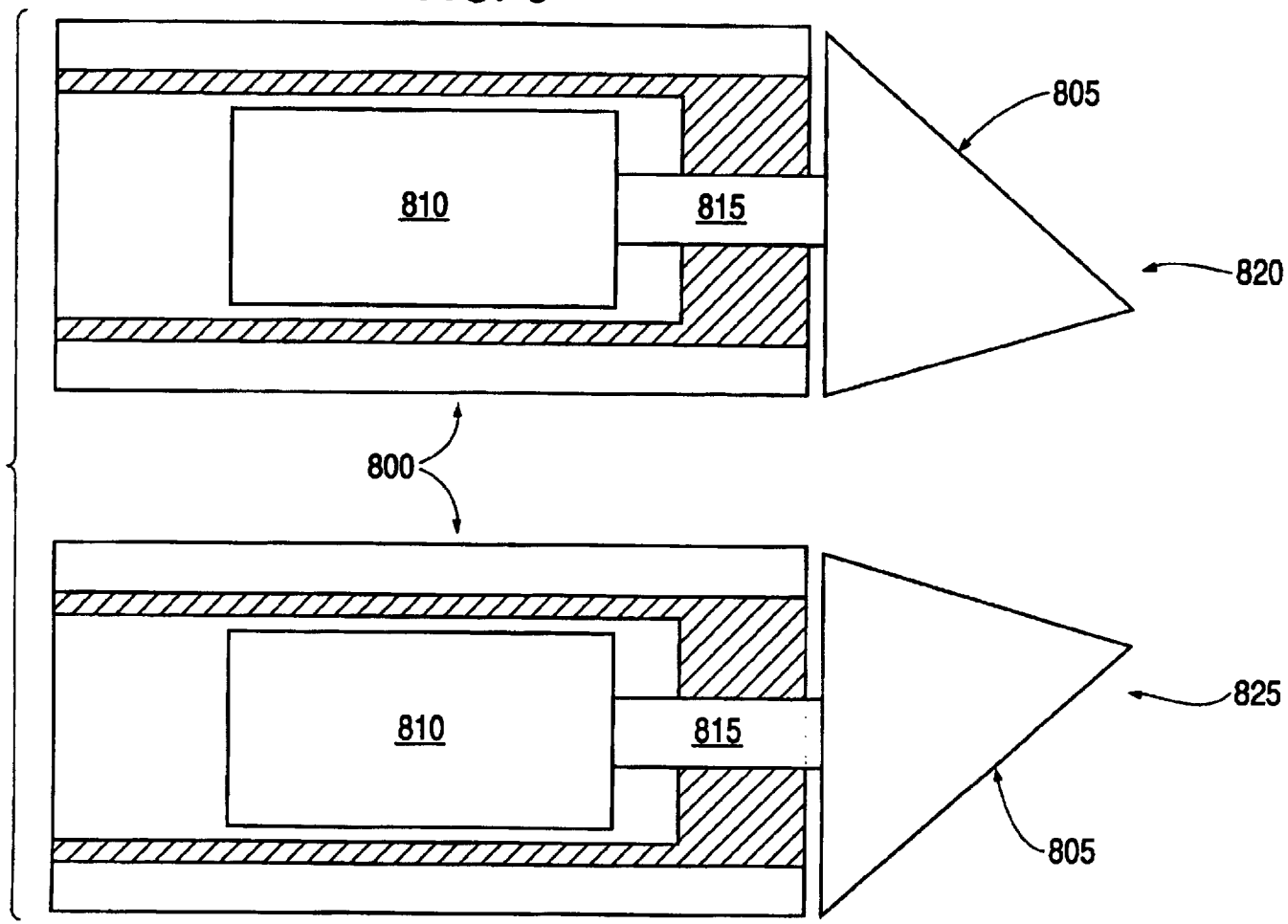
FIG. 8 depicts a rotatable nose section.

FIG. 8 depicts a rotatable nose section 800 (e.g., 715 of FIG. 7 for worm 700). Rotatable nose section 800 includes wedge penetrometer 805. Wedge penetrometer 805, which measures soil compaction force, has the shape of a right circular cone sliced at an angle to its base, although other shapes for wedge penetrometer 805 are also possible. Wedge penetrometer 805 is preferably 10–25° off center. That is, wedge penetrometer 805 preferably is shaped as a right circular cone sliced at an angle of 10–25° to the axis of the cone. More preferably, wedge penetrometer 805 is about 15° off center. Rotatable nose section 800 also includes a motor 810 and a linking portion 815 configured to link motor 810 to wedge penetrometer 805. Motor 810 and linking portion 815 are housed within nose section 830 (e.g., 305 of FIG. 3).

Rotatable nose section 800 may be used to control a direction of locomotion of a worm. In particular, by angling wedge penetrometer down 820 (i.e., such that the shortest slant measurement from the tip of the cone to its base faces down), movement of an attached worm will be directed down. Similarly, by rotating wedge penetrometer to face up 825, movement of an attached worm will be directed up. In this manner, a worm may be directed to turn up, down, left, right, or any direction in between. That is, a forward-moving worm may turn toward any of 360° in the plane perpendicular to the worm's body by rotating wedge penetrometer 805 to face that direction. To achieve movement in the straight forward direction, wedge penetrometer 805 is continuously rotated. Preferably, to move straight forward, wedge penetrometer is rotated at a rate of about one revolution per forward thrust (e.g., S670 of FIG. 6).

Figure 9:
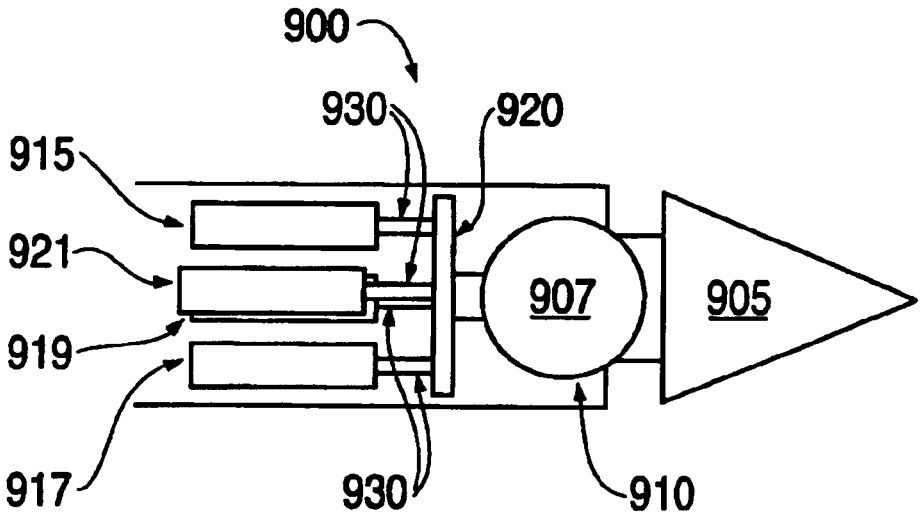
FIG. 9 depicts a manipulable nose section.

FIG. 9 depicts a manipulable nose section 900. Manipulable nose section 900 includes cone penetrometer 905, which is configured to seat in socket arrangement 910. By attaching cone penetrometer 905 to ball 907, cone penetrometer may be mounted in manipulable nose section 900 according to a ball-and-socket joint. Ball 907 is mechanically connected to member 920, which provides an abutment for hydraulic cylinders 915, 917, 919, 921 to act against. Member 920 may be, by way of non-limiting example, generally plate-like in shape, and may have individual shaped portions to receive hydraulic cylinder rods 930. Hydraulic cylinder pistons 930 act against member 920 to direct movement of cone penetrometer 905. One or more of hydraulic cylinders 915, 917, 919, 921 may be extended at once. Cone penetrometer 905 is thereby able to move in multiple directions of an xy-coordinate system (e.g., right, left, up, down, and combinations thereof). The angle of cone penetrometer 905 is manipulable by controllably extending one or more of hydraulic cylinders 915, 917, 919, 921. By partially extending one or more of hydraulic cylinders 915, 917, 919, 921, cone penetrometer 905 may affect any angle between zero and 45 degrees.

Figure 10:
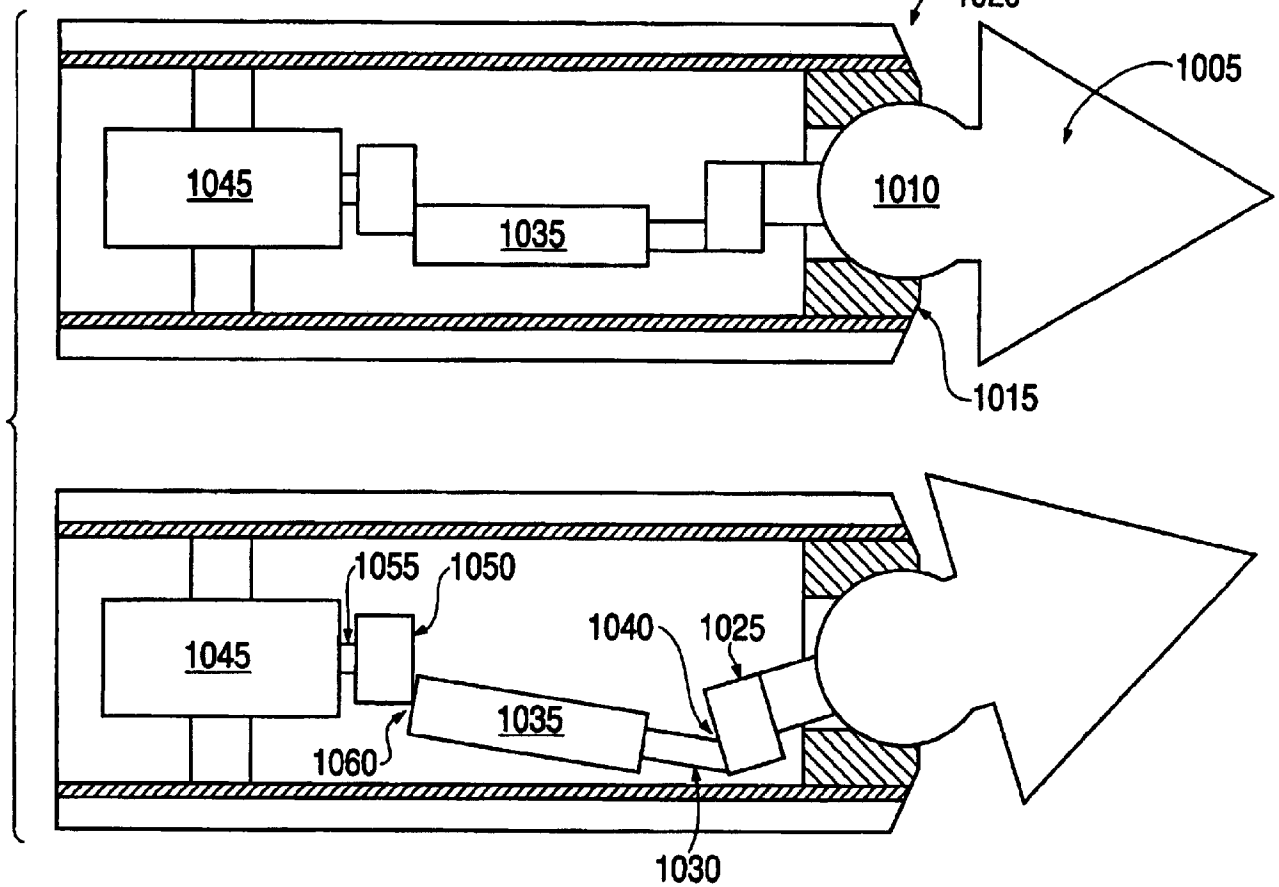
FIG. 10 depicts a manipulable nose section.

FIG. 10 depicts an alternate embodiment of a manipulable nose section. Cone penetrometer 1005 terminates in ball 1010, which seats in socket 1015 to form a ball-and-socket joint 1020. Ball 1010 is attached to pivot member 1025. Hydraulic cylinder rod 1030 of hydraulic cylinder 1035 is attached to pivot member via, by way of non-limiting example, universal joint 1040. Shaft 1055 of motor 1045 mechanically connects to arm 1050. Hydraulic cylinder 1035 is attached to arm 1050 via, by way of non-limiting example, universal joint 1060.

Motor 1045 rotates arm 1050 into a position selected to achieve the desired manipulation. In particular, the position of arm 1050 determines at what angle along 360° cone penetrometer will pivot. To pivot cone penetrometer 1005 at the selected angle, hydraulic cylinder 1035 extends hydraulic cylinder rod 1030. Hydraulic cylinder rod 1030 acts against pivot member 1025, causing pivot member 1025 to rotate away from extended hydraulic cylinder rod 1030. Pivot member 1025 in turn causes attached cone penetrometer to rotate to a desired position at the selected angle. Hydraulic cylinder preferably is incrementally controllable in order to select any position within a continuum from straight ahead to about 30° off-center at the selected angle.

Figure 11:
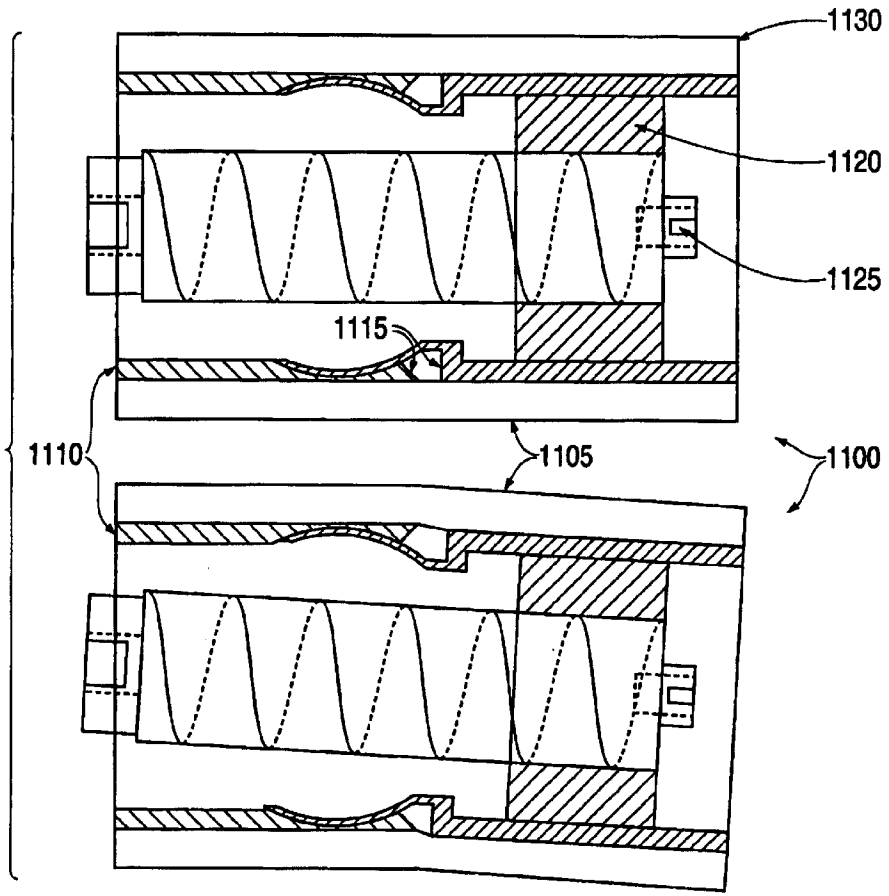
FIG. 11 depicts a rotatable section joint.

FIG. 11 depicts a rotatable section joint 1100 including ball component 1105 and socket component 1110. Each rotatable section joint 1100 allows for up to 5 degrees of movement in any direction. Stops 1115 provide support and limit movement of rotatable section joint 1100. Rotatable section joint is preferably internally threaded at one or both of ball component 1105 and socket component 1110. Internal threading allows for insertion of cylinder disk 1120, which accommodates hydraulic cylinder 1125. Packer membrane 1130 surrounds rotatable section joint 1100.

Figure 12:
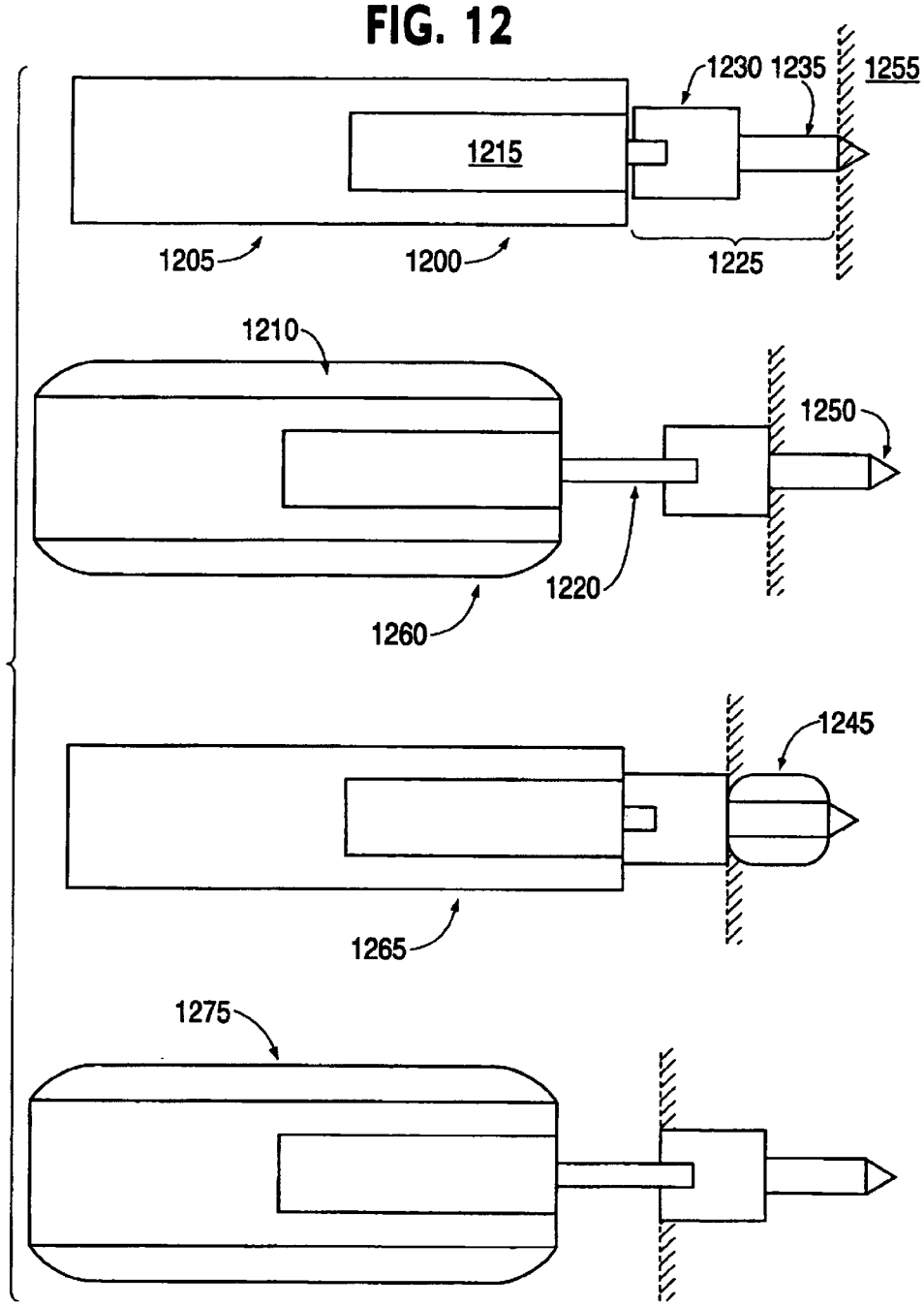
FIGS. 12 and 13 depict locomotion of a self-penetrating soil exploration device.
Figure 13:
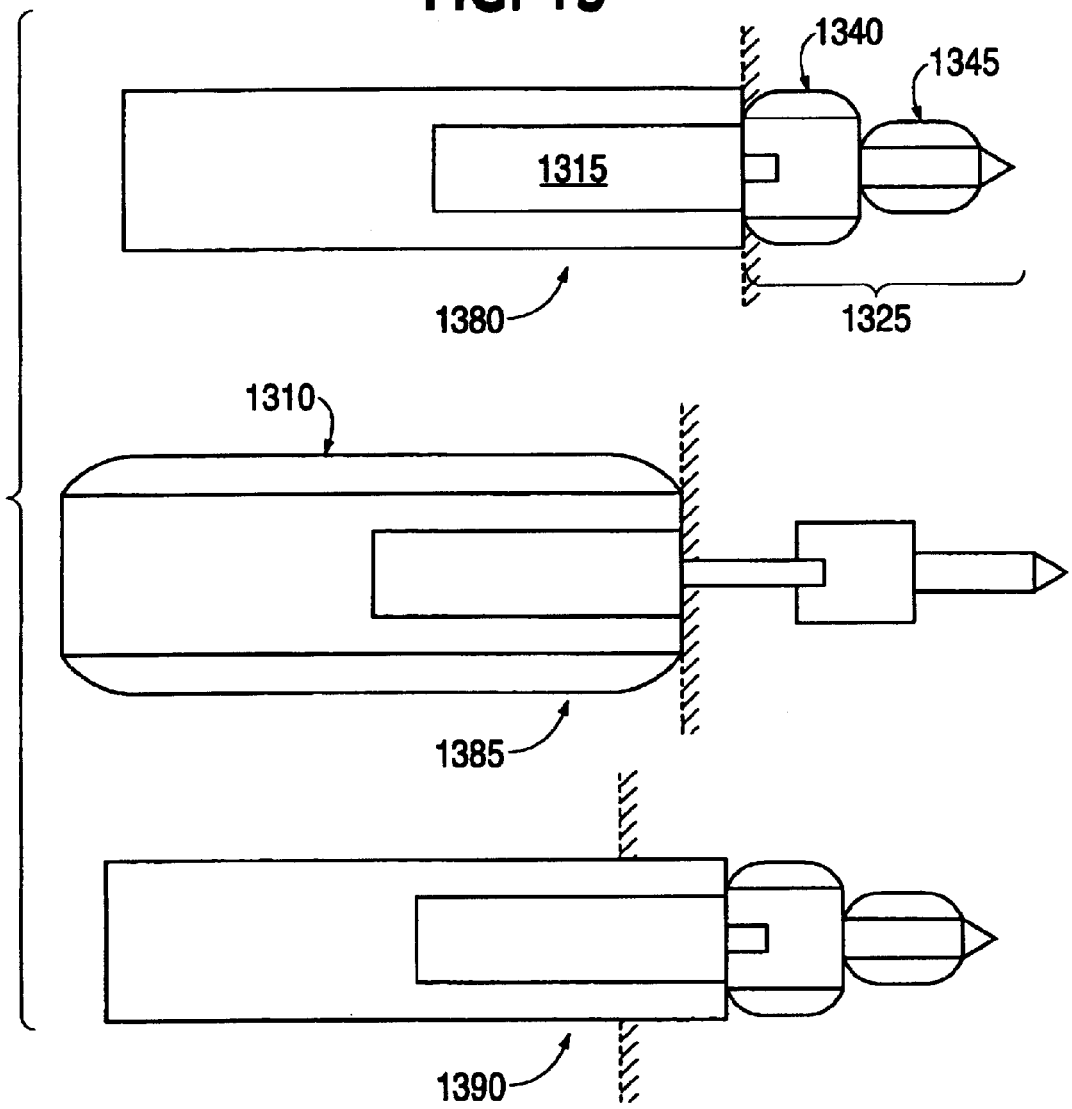

FIGS. 12 and 13 depict locomotion of a self-penetrating soil exploration device 1200 ("worm"). Worm 1200 includes body 1205, which is surrounded by packer 1210. Body packer 1210 is capable of radial expansion by an amount sufficient to provide adequate traction against soil or other medium. Body 1205 houses a single-action spring-return hydraulic cylinder 1215, whose piston rod 1220 is attached to front section 1225. Hydraulic cylinder 1215 is configured to propel nose section 1230 away from body section 1205 preferably by about 3 inches. Front section 1225 includes nose section 1230 and awl section 1235, which terminates in tapered tip 1250. Nose section 1230 and awl section 1235 are surrounded by packers 1240, 1245, respectively. Nose packer 1214 expands to approximately the diameter of body 1205, as measured with packer 1210 deflated. Awl packer 1245 expands to approximately the diameter of nose section 1230, as measured with nose packer 1240 deflated. Note that nose section 1230 and awl section 1235 collectively are preferably about the length that piston rod 1220 is capable of extending nose section 1225 from body 1205. Worm 1200 is tethered by electrical and hydraulic fluid supply lines.

Preferable dimension for worm 1200 are as follows. Body 1205 is preferably about 16 inch long and 4 inches in diameter. Body packer 1210 is preferably capable of radial expansion of about 1 inch, thereby increasing the effective body diameter to about 6 inches. Nose section 1230 is preferably 3 inches long and 2.5 inches in diameter. Awl section 1235 is preferably 3 inches long and 1 inch in diameter. Tapered tip 1250 is preferably an additional 1 inch long. Other body, nose, awl, tip and packer dimensions are also possible.

Locomotion of worm 1200 proceeds as follows. Worm 1200 is initially inserted into a starter tube having an inner diameter capable of being gripped by inflated body packer 1210 and having a length to substantially enclose worm 1200. Body packer 1210 is inflated 1260 and the starter tube is pressed against soil 1255. Hydraulic cylinder 1215 is then expanded, which pushes awl 1235 into soil 1255. Next 1265, body packer 1210 is deflated and awl packer 1245 is inflated, which anchors front section 1225 into soil 1255. Hydraulic cylinder 1215 is then retracted, thereby dragging body section 1205 toward anchored nose section 1225. Body section then 1275 re-inflates to grip the inside of the starter tube. Awl packer 1245 is deflated, and hydraulic cylinder 1215 is extended, further pressing frontal section 1225 into soil 1255.

FIG. 13 continues the description of worm locomotion begun above in reference to FIG. 12. At this point, all of front section 1325 is inserted into soil 1355. To proceed 1380, both nose packer 1340 and awl packer 1345 are inflated, anchoring front section 1325 into soil 1355. Body packer 1310 is deflated, and hydraulic cylinder 1315 is retracted. This action draws body section forward to meet anchored front section 1325. Next 1385, body packer 1310 is inflated to provide friction against the starter tube, and hydraulic cylinder 1315 is extended to push front section 1325 further into soil 1355. Locomotion proceeds 1390 by inflating front section packers 1340, 1345 and retracting hydraulic cylinder 1320 to pull body section 1305 further into soil 1355. Motions 1380 and 1385 are thereafter repeated to further impel worm 1300 through soil 1355. Note that although awl and nose packers can inflate independently, in some circumstances it might be preferred for them to inflate simultaneously.

Figure 14:
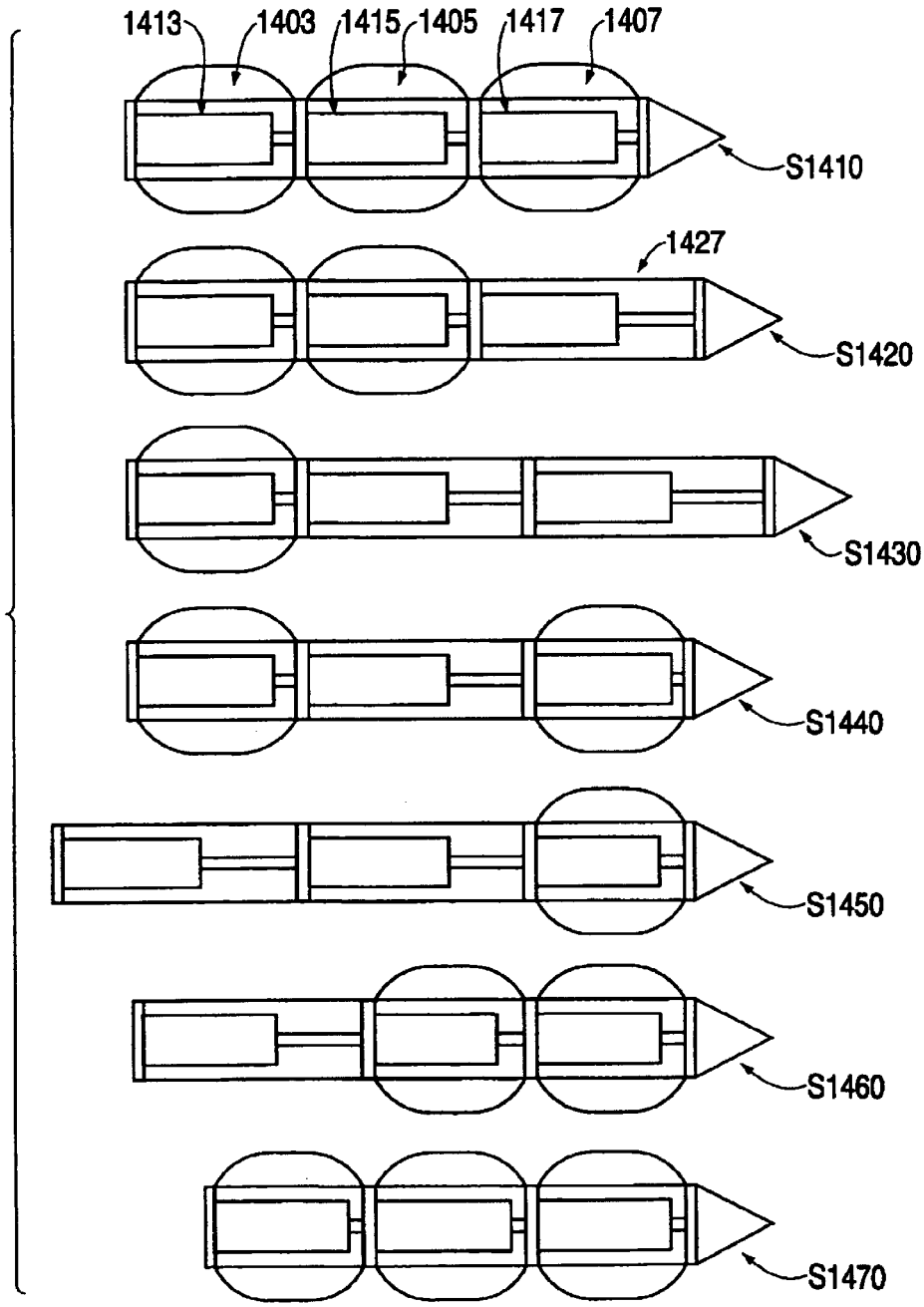
FIG. 14 depicts locomotion of a self-penetrating soil exploration device.

FIG. 14 depicts locomotion of a worm embodiment, in which the worm proceeds according to peristaltic motion. Each cylinder 1403, 1405, 1407 is configured to extend when its associated packer 1413, 1415, 1417, respectively, is deflated. Conversely, each cylinder is configured to retract when its associated packer is inflated. These complementary actions may be accomplished by using a fixed amount of hydraulic fluid for each packer/cylinder pair. This fixed amount of fluid is traded between the packer and its associated cylinder in order to achieve complementary actions.

Motion of the embodiment of FIG. 14 proceeds as follows. To begin a locomotion cycle, at step S1410 each packer 1413, 1415, 1417 is in the inflated state. At step S1420, forward packer 1407 is deflated and forward cylinder is extend, thereby pushing front section 1427 forward into the soil. At step S1430, middle packer 1405 is deflated and middle cylinder 1415 is extended, further pushing worm forward into the soil. At step S1440, front packer 1407 is inflated and front cylinder is retracted. At step S1450, rear packer 1403 is deflated and rear cylinder 1413 is extended. At step S1460, middle packer 1405 is inflated and middle cylinder is retracted. And at step S1470, rear packer 1403 is inflated and rear cylinder 1413 is retracted, thereby returning the worm to its initial state 1410 in a location 1470 forward from its initial location at step S1410. This completes the locomotion cycle.

FIG. 15 is a chart of estimated resistance forces for different worm dimensions and soil types. In particular, for various nose section diameters 1505, nose section area 1510 is approximated and resistances 1515 for pushing the nose section through different soil types 1502 are estimated. Required driving forces 1520 measured in pounds are derived from cone tip resistance 1515 measured in pounds per square feet using techniques known to those of ordinary skill in the art. Next, body reaction forces 1525, 1535 in terms of pounds per foot of packer length are derived for 2 inch diameter worm bodies and 3 inch diameter bodies, respectively. Reaction forces 1525, 1535 are used to estimate required lengths 1530, 1540, respectively. These lengths 1530, 1540 represent estimated minimal packer lengths required to provide enough power to push the associated nose section through the associated soil types.

FIG. 16 is a chart estimating reaction forces (e.g., 1525, 1535 of FIG. 15) against sand for various packer diameters. In particular, main packer diameter 1605 is used to approximate worm perimeter area 1610, measured in square feet per foot. Column 1615 indicates a depth of 10 feet in sand, from which soil failure pressure 1620 is estimated as at least 10,000 pounds per square foot (PSF) based on 6.5 times the shear strength. Soil failure pressures 1620 are based on experimental information and represent conservative pressures. That is, actual soil failure pressures are expected to be at least as large as derived soil failure pressures 1620. Soil friction factor 1625 is estimated at 0.7 based on a friction angle for sand of 35°. From soil failure pressures 1620, soil friction factors 1625, and main packer diameters 1605, sand reaction forces 1640 are estimated for 1 foot long packers 1630 having an effective packer length of 0.95 feet. These values are used to estimate minimal worm lengths (e.g., 1530, 1540 of FIG. 15). The estimations are based on techniques known to those of ordinary skill in the art.

FIG. 17 is a chart estimating reaction forces (e.g., 1525, 1535 of FIG. 15) against clay for various packer dimensions at a depth 1710 of 10 feet. Estimations analogous to those described above in reference to FIG. 16 are derived using techniques known to those of ordinary skill in the art, except that in FIG. 16, soil failure pressure 1715 is estimated at 5500 PSF, and soil friction factor 1720 is estimated at 0.404 based on a friction angle of 22°. From these parameters, clay reaction forces 1740 are estimated for 1 foot long packers 1725 having 0.95 foot effective lengths 1730. These values are used to estimate minimal worm lengths (e.g., 1530, 1540 of FIG. 15).

Typically, to have sufficient frictional force to travel horizontally, a worm should operate at depths of at least 3–6 feet. To have sufficient frictional force to travel vertically, a worm should typically operate at depths of at least three feet.

Alternative embodiments of the present invention are contemplated. Worm body cross-section may be circular, polygonal, or oval. The nose and tail may be same diameter as middle portions (e.g., as an alternative to the embodiment of FIG. 1). The communication with surface control may be wireless. Drill bits may be attached to the rotatable nose section (e.g., 800 of FIG. 8) in place of a wedge penetrometer in order to provide movement capability through hard materials. Internal disks (500 of FIG. 5) may have more than one offset through-hole to accommodate different numbers of hydraulic or electrical lines. In an alternative to a starter tube, a hole may be bored or dug and the worm may be inserted. The medium through which the worm burrows may be soil, earth, sand, light gravel, grain, plastic, or other materials.

Regarding the hydraulic and packer mechanisms, the following are contemplated. More or less packers, including more or less directional packers, may be used. Each packer or cylinder may have its own dedicated hydraulic line from the surface. Alternately, a single supply line may be used for all of the packers and cylinders. In an alternate embodiment, one supply line may feed the cylinders and another supply line may feed the packers. The packer membrane may be attached to the packer cylinder by way of "O" ring slip cylinders instead of stainless steel clamps (e.g., 220 of FIG. 2). Dual-action hydraulic cylinders may be used instead of single-action spring-return cylinders.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An apparatus for maneuvering through soil comprising:

a substantially longitudinal body including a front end, said body being configured to impel itself through a medium comprising solid matter; and a manipulable nose section comprising at least one of:

at least two members arranged radially on said front end, each member controllably protrudable in a substantially radial direction relative to said longitudinal body;

an off-center nose section rotatable about a longitudinal axis of said nose section and having a non-symmetrical cross section taken parallel to said longitudinal axis of said nose section, a pivotable nose section;

wherein manipulating said nose section alters a direction of travel of said apparatus.

2. The apparatus of claim 1 wherein said body comprises expandable bladders configured to assist in impelling said body.

3. The apparatus of claim 1 wherein said manipulable nose section comprises at least two members arranged radially on said front end, said at least two members comprising at least three members.

4. The apparatus of claim 1 wherein said manipulable nose section comprises at least two members arranged radially on said front end, said at least two members comprising expandable bladders.

5. The apparatus of claim 1 wherein said manipulable nose section is rotatable.

6. The apparatus of claim 1 wherein said manipulable nose section comprises a pivotable nose section, said a pivotable nose section comprising a ball-and-socket joint.

7. The apparatus of claim 1 wherein said substantially longitudinal body comprises at least one joint configured to allow a first portion of said substantially longitudinal body to form a nonzero angle with respect to a second portion of said substantially longitudinal body.

8. An apparatus for maneuvering through a medium such as soil comprising:

a substantially longitudinal body;

at least two expandable portions of said body capable of engaging surrounding media;

a manipulable nose section;

a linear extender capable of extending and retracting said body and said nose section relative to each other in a longitudinal direction; and wherein manipulating said manipulable nose section alters a direction of travel of said apparatus.

9. The apparatus of claim 8 wherein said expandable portions comprise expandable bladders.

10. The apparatus of claim 8 wherein said manipulable nose section comprises at least two members arranged radially on said front end, said at least two members comprising expandable bladders.

11. The apparatus of claim 8 wherein said manipulable nose section comprises a rotatable off-center nose section, said rotatable off-center nose section comprising a substantially conical member that is eccentric to said body.

12. The apparatus of claim 8 wherein said manipulable nose section comprises a pivotable nose section, said a pivotable nose section comprising a ball-and-socket joint.

13. The apparatus of claim 8 wherein said substantially longitudinal body comprises at least one joint configured to allow a first portion of said substantially longitudinal body to form a nonzero angle with respect to a second portion of said substantially longitudinal body.

14. An apparatus for maneuvering through soil comprising:

a substantially longitudinal body, said body including and being configured to impel itself using hydraulic cylinders through a medium comprising solid matter in substantially a direction parallel to said longitudinal body; and a controllably manipulable nose section;

wherein controllably manipulating said controllably manipulable nose section alters a direction of travel of said apparatus.

15. The apparatus of claim 14 wherein said body comprises expandable bladders configured to assist in impelling said body.

16. The apparatus of claim 14 wherein said controllably manipulable nose section comprises a hydraulically controllably manipulable nose section.

17. The apparatus of claim 14 wherein said controllably manipulable nose section is controllably manipulable in a plurality of directions.

18. The apparatus of claim 14 wherein said controllably manipulable nose section is capable of rotating.

19. The apparatus of claim 14 wherein said controllably manipulable nose section is capable of being positioned at an off-center angle.

20. The apparatus of claim 14 wherein said controllably manipulable nose section comprises at least two protrudable members.

21. The apparatus of claim 14 wherein said substantially longitudinal body comprises a plurality of sections, at least one of said plurality of sections being capable of forming a nonzero angle with respect to another of said plurality of sections.

22. A method of maneuvering through soil comprising:

gripping an inside surface of a channel;

advancing at least a portion of a substantially longitudinal body through the channel in a first direction of travel, the first direction of travel being substantially parallel to the longitudinal body; and manipulating a nose section, the nose section being operatively connected to a plurality of hydraulic cylinders that can each manipulate the orientation of the nose section, said manipulating comprising moving at least one of the plurality of hydraulic cylinders;

wherein said manipulating alters the first direction of travel to produce a second direction of travel that is eccentric to the first direction of travel.

23. The method of claim 22 wherein said manipulating comprises hydraulically manipulating.

24. The method of claim 22 wherein said manipulating comprises positioning said nose section off-center.

25. The method of claim 22 wherein said manipulating comprises rotating.

26. The method of claim 22 wherein said manipulating comprises extending at least one member.

27. The method of claim 22 wherein said substantially longitudinal body comprises a plurality of sections, at least one of said plurality of sections being capable of forming a nonzero angle with respect to another of said plurality of sections.

28. A method of maneuvering through soil comprising:

gripping an inside surface of a channel;

advancing at least a portion of a substantially longitudinal body through the channel in a first direction of travel, the first direction of travel being substantially parallel to said longitudinal body; and controllably changing directional characteristics of a nose section by expanding bladders;

wherein said controllably changing alters the first direction of travel to produce a second direction of travel that is eccentric to the first direction of travel.

29. The method of claim 28 wherein said controllably changing comprises positioning said nose section at a nonzero angle to said first direction of travel.

30. The method of claim 28 wherein said controllably changing comprises rotating.

31. The method of claim 28 wherein said substantially longitudinal body comprises a plurality of sections, at least one of said plurality of sections being capable of forming a nonzero angle with respect to another of said plurality of sections.

32. A method of altering a direction of travel of a mechanical burrowing device comprising:

providing a mechanical burrowing device having a longitudinal orientation and a radial orientation which impels itself through a medium using at least hydraulic cylinders disposed inside of a body of the device;

controllably manipulating a nose section of the mechanical burrowing device, said controllably manipulating comprising at least one of:

rotating the nose section;

positioning said rose section off-center from said longitudinal direction; and extending at least one member radially from the nose section;

gripping an inside of a hole in which the mechanical burrowing device is disposed; and expanding in a longitudinal direction at least a portion of the mechanical burrowing device;

wherein said controllably manipulating causes the mechanical burrowing device to alter a direction of travel.

33. The method of claim 32 wherein said gripping comprises expanding a bladder.

34. The method of claim 32 wherein said expanding comprises expanding using hydraulic force.

35. The method of claim 32 wherein said substantially longitudinal body comprises a plurality of sections, at least one of said plurality of sections being capable of angling with respect to another of said plurality of sections.

* * * * *